US012225942B2

(12) United States Patent
Moloney

(10) Patent No.: US 12,225,942 B2
(45) Date of Patent: Feb. 18, 2025

(54) FLOW DIRECTING MEMBER FOR A VAPOR PROVISION SYSTEM

(71) Applicant: NICOVENTURES TRADING LIMITED, London (GB)

(72) Inventor: Patrick Moloney, London (GB)

(73) Assignee: NICOVENTURES TRADING LIMITED, London (GB)

( * ) Notice: Subject to any disclaimer, the term of this patent is extended or adjusted under 35 U.S.C. 154(b) by 471 days.

(21) Appl. No.: 17/593,308

(22) PCT Filed: Mar. 11, 2020

(86) PCT No.: PCT/GB2020/050588
§ 371 (c)(1),
(2) Date: Sep. 15, 2021

(87) PCT Pub. No.: WO2020/188246
PCT Pub. Date: Sep. 24, 2020

(65) Prior Publication Data

US 2022/0175042 A1 Jun. 9, 2022

(30) Foreign Application Priority Data

Mar. 15, 2019 (GB) ..... 1903537
Jul. 15, 2019 (GB) ..... 1910102

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/485; A24F 40/10; A24F 40/42; A24F 40/40; A24F 40/46; A24F 40/465; A24F 40/48
(Continued)

(56) References Cited

U.S. PATENT DOCUMENTS 8,794,231 B2 8/2014 Thorens et al.
9,308,336 B2 4/2016 Newton
(Continued)

FOREIGN PATENT DOCUMENTS

CN 201146824 Y 11/2008
CN 203828068 U 9/2014
(Continued)

OTHER PUBLICATIONS

International Search Report and Written Opinion for PCT/GB2020/050588 date mailed Sep. 18, 2020.
(Continued)

*Primary Examiner* — Alexander Gilman
(74) *Attorney, Agent, or Firm* — Husch Blackwell

(57) ABSTRACT

A flow directing member for a vapor provision system is configured for engagement with an opening in a wall of a housing defining a reservoir for aerosolizable substrate material and with an opening in a wall of the housing defining an air flow passage, and has a liquid flow channel extending therethrough from a liquid inlet to a liquid outlet such that when the flow directing member is engaged with the housing, the liquid inlet is in communication with the reservoir and the liquid outlet is in communication with a volume for aerosol generation external to the reservoir so that aerosolizable substrate material can flow from the reservoir to the volume; and an aerosol flow channel extending therethrough from an aerosol inlet to an aerosol outlet such that when the flow directing member is engaged with
(Continued)

the housing, the aerosol inlet is in communication with the volume and the aerosol outlet is in communication with the air flow passage so that aerosol can flow from the volume to the air flow passage.

26 Claims, 4 Drawing Sheets

(58) Field of Classification Search
USPC ..... 131/329
See application file for complete search history.

(56) References Cited

U.S. PATENT DOCUMENTS 9,497,997 B2* 11/2016 Wu ..... A61M 11/042
9,596,887 B2 3/2017 Newton
9,861,135 B2 1/2018 Chen
9,877,508 B2* 1/2018 Kane ..... A24F 40/42
9,888,720 B2 2/2018 Chen
9,888,920 B2* 2/2018 Mayer ..... A61B 17/0686
9,999,255 B2* 6/2018 Li ..... H05B 1/0244
10,004,263 B2* 6/2018 Liu ..... H05B 1/0227
10,015,986 B2* 7/2018 Cadieux ..... A24F 42/10
10,045,568 B2* 8/2018 Monsees ..... A61M 15/06
10,070,668 B2* 9/2018 Li ..... A24F 40/40
10,076,139 B2* 9/2018 Monsees ..... A61M 15/06
10,104,912 B2* 10/2018 Sur ..... A24F 40/465
10,492,539 B2* 12/2019 Chen ..... H05B 3/44
10,575,558 B2* 3/2020 Bless ..... B23K 26/20
10,881,141 B2* 1/2021 Fraser ..... A24F 40/44
11,259,570 B2* 3/2022 Pan ..... A24F 40/44
2004/0060556 A1* 4/2004 Halamish ..... A61M 11/06 128/200.14
2013/0284192 A1* 10/2013 Peleg ..... A24F 40/53 131/329
2014/0261490 A1* 9/2014 Kane ..... A24F 40/485 131/328
2014/0299138 A1* 10/2014 Xiang ..... A24F 40/53 340/309.16
2014/0355969 A1 12/2014 Stern
2015/0216236 A1* 8/2015 Bless ..... B23K 26/20 131/328
2015/0245660 A1* 9/2015 Lord ..... F22B 1/284 131/328
2015/0245669 A1* 9/2015 Cadieux ..... A24F 40/465 131/329
2015/0272217 A1 10/2015 Chen
2015/0305406 A1* 10/2015 Li ..... A24F 40/42 392/390
2015/0328415 A1 11/2015 Minskoff et al.
2015/0342256 A1 12/2015 Chen
2015/0342258 A1* 12/2015 Chen ..... A24F 40/44 131/329
2016/0007655 A1* 1/2016 Li ..... A24F 40/46 392/390
2016/0095354 A1* 4/2016 Wu ..... A24F 40/485 392/404
2016/0106153 A1 4/2016 Zhu
2016/0192708 A1 7/2016 Demeritt et al.
2016/0316820 A1 11/2016 Liu
2016/0338406 A1 11/2016 Liu
2016/0345625 A1 12/2016 Liu
2016/0360784 A1 12/2016 Liu
2016/0366937 A1 12/2016 Liu
2016/0374401 A1* 12/2016 Liu ..... A24F 40/50 131/328
2017/0071260 A1* 3/2017 Li ..... A24F 40/42
2017/0112193 A1* 4/2017 Chen ..... A24F 40/46
2017/0119052 A1* 5/2017 Williams ..... H05B 3/44
2017/0135398 A1* 5/2017 Scott ..... A61M 11/042
2017/0143041 A1 5/2017 Batista et al.
2017/0202266 A1* 7/2017 Sur ..... A61M 11/041
2017/0224016 A1* 8/2017 Reevell ..... H05B 3/04
2017/0224017 A1 8/2017 Li et al.
2017/0273359 A1* 9/2017 Liu ..... A61M 11/042
2017/0280771 A1* 10/2017 Courbat ..... B05B 17/0661
2017/0280778 A1 10/2017 Force
2017/0340014 A1* 11/2017 Batista ..... A24F 40/485
2017/0360092 A1 12/2017 Althorpe et al.
2017/0360093 A1* 12/2017 Fernando ..... B05B 7/2435
2017/0367407 A1 12/2017 Althorpe et al.
2018/0029867 A1* 2/2018 Biel ..... B65D 47/06
2018/0084828 A1 3/2018 Phillips et al.
2018/0119502 A1* 5/2018 Shanks ..... B01D 19/0052
2018/0125117 A1 5/2018 Demeritt et al.
2018/0132531 A1 5/2018 Sur et al.
2018/0213850 A1 8/2018 Brinkley et al.
2018/0242648 A1 8/2018 Dooly et al.
2018/0325171 A1 11/2018 Zhu
2018/0325175 A1* 11/2018 Sudlow ..... A24F 40/40
2018/0343922 A1* 12/2018 Stadler ..... A24F 40/485
2019/0269177 A1* 9/2019 Liu ..... A24F 40/00
2022/0125107 A1* 4/2022 Moloney ..... A24F 40/70
2022/0167672 A1* 6/2022 Moloney ..... H05B 3/42
2022/0175042 A1* 6/2022 Moloney ..... A24F 40/42
2023/0112844 A1* 4/2023 Force ..... H05B 3/04 392/404
2023/0292837 A1* 9/2023 Force ..... A24F 40/44 392/404

FOREIGN PATENT DOCUMENTS

CN 104114050 A 10/2014
CN 203872997 U 10/2014
CN 105307519 A 2/2016
CN 105394816 A 3/2016
CN 106102491 A 11/2016
CN 106136331 A 11/2016
CN 106170215 A 11/2016
CN 206119185 U 4/2017
CN 106686995 A 5/2017
CN 106998819 A 8/2017
CN 107454883 A 12/2017
CN 107865462 A 4/2018
CN 108348711 A 7/2018
CN 108430242 A 8/2018
CN 108471813 A 8/2018
CN 108778006 A 11/2018
EP 2949228 A2 12/2015
EP 2965642 1/2016
EP 3135139 3/2017
EP 3158882 4/2017
EP 2949228 B1 5/2017
EP 2950675 B1 10/2017
JP 2015519903 A 7/2015
JP 2017501682 A 1/2017
JP 2017504361 A 2/2017
KR 20180123701 A 11/2018
RU 2653675 C1 5/2018
RU 2673580 C1 11/2018
WO 2015127666 A1 9/2015
WO 2015179002 A2 11/2015
WO 2015189556 A1 12/2015
WO 2016010864 A1 1/2016
WO WO2016061859 4/2016
WO WO2016079155 5/2016
WO 2016092261 A1 6/2016
WO 2016106476 A1 7/2016
WO 2016128562 A1 8/2016
WO 2017163050 A1 9/2017
WO 2017206189 A1 12/2017
WO WO2018054388 3/2018
WO WO2018072373 4/2018
WO 2018094564 A1 5/2018
WO 2019042331 A1 3/2019

OTHER PUBLICATIONS

"International Preliminary Report on Patentability received for PCT Patent Application No. PCT/GB2020/050587, mailed on Jun. 23, 2021", 14 pages.

(56) References Cited

OTHER PUBLICATIONS

"International Preliminary Report on Patentability received for PCT Patent Application No. PCT/GB2020/050588, mailed on Sep. 30, 2021", 16 pages.
"International Search Report and Written Opinion received for PCT Patent Application No. PCT/GB2020/050587, mailed on Jun. 4, 2020", 16 pages.
"Invitation to Pay Additional Fees received for PCT Patent Application No. PCT/GB2020/050588, mailed on Jun. 2, 2020", 15 pages.
"Office Action received for Russian Patent Application No. 2021126950, mailed on May 24, 2022", 9 pages.
"Reason for Refusal received for Japanese Patent Application No. 2021-551779, mailed on Nov. 8, 2022", 10 pages (5 pages of English Translation and 5 pages of Official Copy).
"Reasons for Refusal received for Japanese Patent Application No. 2021-551537, mailed on Oct. 25, 2022", 8 pages (4 pages of English Translation and 4 pages of Official Copy).
"Notice of Allowance received for Chinese Patent Application No. 202080021689.X, mailed on May 2, 2024", 7 pages (2 pages of English Translation and 5 pages of Official Copy).
"Office Action received for Chinese Patent Application No. 202080021245.6, mailed on Jan. 5, 2024", 12 pages (9 Pages of English Translation and 3 pages of Official Copy).

* cited by examiner

FLOW DIRECTING MEMBER FOR A VAPOR PROVISION SYSTEM

The present application is a National Phase entry of PCT Application No. PCT/GB2020/050588, filed Mar. 11, 2020 which claims priority from GB Patent Application No. 1903537.7 filed Mar. 15, 2019 and GB Patent Application No. 1910102.1 filed Jul. 15, 2019, each of which is hereby fully incorporated herein by reference.

TECHNICAL FIELD

The present disclosure relates to a flow directing member for a vapor provision system and to a housing for a vapor provision system, and a cartomizer for a vapor provision system, and a vapor provision system comprising such a flow directing member and/or such a housing.

BACKGROUND

Many electronic vapor provision systems, such as e-cigarettes and other electronic nicotine delivery systems that deliver nicotine via vaporized liquids, are formed from two main components or sections, namely a cartridge or cartomizer section and a control unit (battery section). The cartomizer generally includes a reservoir of liquid and an atomizer for vaporizing the liquid. These parts may collectively be designated as an aerosol source. The atomizer generally combines the functions of porosity or wicking and heating in order to transport liquid from the reservoir to a location where it is heated and vaporized. For example, it may be implemented as an electrical heater, which may be a resistive wire formed into a coil or other shape for resistive (Joule) heating or a susceptor for induction heating, and a porous element with capillary or wicking capability in proximity to the heater which absorbs liquid from the reservoir and carries it to the heater. The control unit generally includes a battery for supplying power to operate the system. Electrical power from the battery is delivered to activate the heater, which heats up to vaporize a small amount of liquid delivered from the reservoir. The vaporized liquid is then inhaled by the user.

The components of the cartomizer can be intended for short term use only, so that the cartomizer is a disposable component of the system, also referred to as a consumable. In contrast, the control unit is typically intended for multiple uses with a series of cartomizers, which the user replaces as each expires. Consumable cartomizers are supplied to the consumer with a reservoir pre-filled with liquid, and intended to be disposed of when the reservoir is empty. For convenience and safety, the reservoir is sealed and designed not to be easily refilled, since the liquid may be difficult to handle. It is simpler for the user to replace the entire cartomizer when a new supply of liquid is needed.

In this context, it is desirable that cartomizers are straightforward to manufacture and comprise few parts. They can hence be efficiently manufactured in large quantities at low cost with minimum waste. Cartomizers of a simple design are hence of interest.

SUMMARY

According to a first aspect of some embodiments described herein, there is provided a flow directing member for a vapor provision system, configured for engagement with an opening in a wall of a housing defining a reservoir for aerosolizable substrate material and with an opening in a wall of the housing defining an air flow passage, the flow directing member having: a liquid flow channel extending therethrough from a liquid inlet to a liquid outlet such that when the flow directing member is engaged with the housing, the liquid inlet is in communication with the reservoir and the liquid outlet is in communication with a volume for aerosol generation external to the reservoir so that aerosolizable substrate material can flow from the reservoir to the volume; and an aerosol flow channel extending therethrough from an aerosol inlet to an aerosol outlet such that when the flow directing member is engaged with the housing, the aerosol inlet is in communication with the volume and the aerosol outlet is in communication with the air flow passage so that aerosol can flow from the volume to the air flow passage.

According to a second aspect of some embodiments described herein, there is provided a reservoir for holding aerosolizable substrate material in a vapor provision system, comprising a housing having walls that define the reservoir and an air flow passage, and an opening in one of the walls defining the reservoir and another opening in one of the walls defining the air flow passage, and a flow directing member according to the first aspect.

According to a third aspect of some embodiments described herein, there is provided a cartridge for a vapor generation system comprising a flow directing member according to the first aspect, or a reservoir according to the second aspect.

According to a fourth aspect of some embodiments described herein, there is provided a vapor provision system comprising a flow directing member according to the first aspect, or a reservoir according to the second aspect, or a cartridge according the third aspect.

According to a fifth aspect of some embodiment described herein, there is provided a housing for a cartomizer portion of a vapor provision system, the housing comprising: an outer wall defining an inner volume with a longitudinal axis, a first end and a second end; one or more interior walls extending from at least the first end and connected to an inner surface or surfaces of the outer wall to divide the inner volume into three regions comprising: a reservoir region closed at or adjacent the second end of the inner volume and having at least one liquid outlet at the first end, the reservoir region having a common longitudinal axis with the outer wall; and first and second air flow regions arranged one on either side of the reservoir region, and the first and second air flow regions having at least one air inlet at the first end and at least one air outlet at the second end.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a flow directing member, or a housing, or a vapor provision system comprising a flow directing member and/or a housing may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which:

FIGS. 4, 4(A), 4(B) and 4(C) show simplified schematic cross-sectional views of a further example cartomizer in which aspects of the disclosure can be implemented;

DETAILED DESCRIPTION

Figure 1:
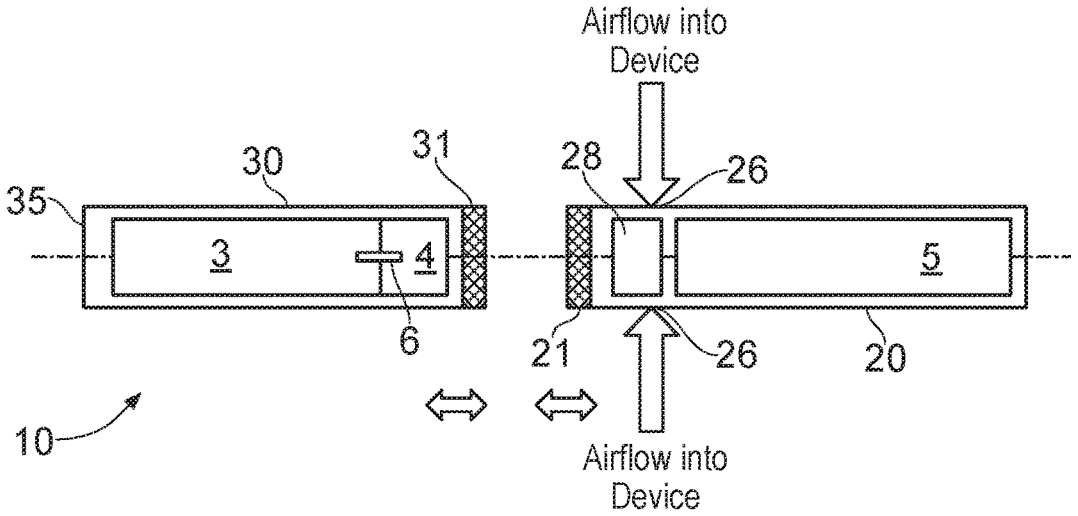
FIG. 1 shows a cross-section through an example e-cigarette comprising a cartomizer and a control unit.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The systems are intended to generate an inhalable aerosol by vaporization of a substrate in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The term "aerosolizable substrate material" as used herein is intended to refer to substrate materials which can form an aerosol, either through the application of heat or some other means. The term "aerosol" may be used interchangeably with "vapor".

As used herein, the term "component" is used to refer to a part, section, unit, module, assembly or similar of an electronic cigarette or similar device that incorporates several smaller parts or elements, possibly within an exterior housing or wall. An electronic cigarette may be formed or built from one or more such components, and the components may be removably or separably connectable to one another, or may be permanently joined together during manufacture to define the whole electronic cigarette. The present disclosure is applicable to (but not limited to) systems comprising two components separably connectable to one another and configured, for example, as an aerosolizable substrate material carrying component holding liquid or another aerosolizable substrate material (a cartridge, cartomizer or consumable), and a control unit having a battery for providing electrical power to operate an element for generating vapor from the substrate material. For the sake of providing a concrete example, in the present disclosure, a cartomizer is described as an example of the aerosolizable substrate material carrying portion or component, but the disclosure is not limited in this regard and is applicable to any configuration of aerosolizable substrate material carrying portion or component. Also, such a component may include more or fewer parts than those included in the examples.

The present disclosure is particularly concerned with vapor provision systems and components thereof that utilize aerosolizable substrate material in the form of a liquid or a gel which is held in a reservoir, tank, container or other receptacle comprised in the system. An arrangement for delivering the substrate material from the reservoir for the purpose of providing it for vapor/aerosol generation is included. The terms "liquid", "gel", "fluid", "source liquid", "source gel", "source fluid" and the like may be used interchangeably with "aerosolizable substrate material" and "substrate material" to refer to aerosolizable substrate material that has a form capable of being stored and delivered in accordance with examples of the present disclosure.

FIG. 1 is a highly schematic diagram (not to scale) of a generic example aerosol/vapor provision system such as an e-cigarette 10, presented for the purpose of showing the relationship between the various parts of a typical system and explaining the general principles of operation. The e-cigarette 10 has a generally elongate shape in this example, extending along a longitudinal axis indicated by a dashed line, and comprises two main components, namely a control or power component, section or unit 20, and a cartridge assembly or section 30 (sometimes referred to as a cartomizer or clearomiser) carrying aerosolizable substrate material and operating as a vapor-generating component.

The cartomizer 30 includes a reservoir 3 containing a source liquid or other aerosolizable substrate material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. For a consumable cartomizer, the reservoir 3 may be sealed after filling during manufacture so as to be disposable after the source liquid is consumed, otherwise, it may have an inlet port or other opening through which new source liquid can be added by the user. The cartomizer 30 also comprises an electrically powered heating element or heater 4 located externally of the reservoir tank 3 for generating the aerosol by vaporization of the source liquid by heating. A liquid transfer or delivery arrangement (liquid transport element) such as a wick or other porous element 6 may be provided to deliver source liquid from the reservoir 3 to the heater 4. A wick 6 may have one or more parts located inside the reservoir 3, or otherwise be in fluid communication with the liquid in the reservoir 3, so as to be able to absorb source liquid and transfer it by wicking or capillary action to other parts of the wick 6 that are adjacent or in contact with the heater 4. This liquid is thereby heated and vaporized, to be replaced by new source liquid from the reservoir for transfer to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or atomizer assembly, and the reservoir with its source liquid plus the atomizer may be collectively referred to as an aerosol source. Other terminology may include a liquid delivery assembly or a liquid transfer assembly, where in the present context these terms may be used interchangeably to refer to a vapor-generating element (vapor generator) plus a wicking or similar component or structure (liquid transport element) that delivers or transfers liquid obtained from a reservoir to the vapor generator for vapor/aerosol generation. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). In an electrical or electronic device, the vapor generating element may be an electrical heating element that operates by ohmic/resistive (Joule) heating or by inductive heating. In general, therefore, an atomizer can be considered as one or more elements that implement the functionality of a vapor-generating or vaporizing element able to generate vapor from source liquid delivered to it, and a liquid transport or delivery element able to deliver or transport liquid from a reservoir or similar liquid store to the vapor generator by a wicking action/capillary force. An atomizer is typically housed in a cartomizer component of a vapor generating system. In some designs, liquid may be dispensed from a reservoir directly onto a vapor generator with no need for a distinct wicking or capillary element. Embodiments of the disclosure are applicable to all and any such configurations which are consistent with the examples and description herein.

Returning to FIG. 1, the cartomizer 30 also includes a mouthpiece or mouthpiece portion 35 having an opening or air outlet through which a user may inhale the aerosol generated by the atomizer 4.

The power component or control unit 20 includes a cell or battery 5 (referred to herein after as a battery, and which may be re-chargeable) to provide power for electrical components of the e-cigarette 10, in particular to operate the heater 4. Additionally, there is a controller 28 such as a printed circuit board and/or other electronics or circuitry for generally controlling the e-cigarette. The control electronics/circuitry 28 operates the heater 4 using power from the battery 5 when vapor is required, for example in response to a signal from an air pressure sensor or air flow sensor (not shown) that detects an inhalation on the system 10 during which air enters through one or more air inlets 26 in the wall of the control unit 20. When the heating element 4 is operated, the heating element 4 vaporizes source liquid delivered from the reservoir 3 by the liquid delivery element 6 to generate the aerosol, and this is then inhaled by a user through the opening in the mouthpiece 35. The aerosol is carried from the aerosol source to the mouthpiece 35 along one or more air channels (not shown) that connect the air inlet 26 to the aerosol source to the air outlet when a user inhales on the mouthpiece 35.

The control unit (power section) 20 and the cartomizer (cartridge assembly) 30 are separate connectable parts detachable from one another by separation in a direction parallel to the longitudinal axis, as indicated by the double-ended arrows in FIG. 1. The components 20, 30 are joined together when the device 10 is in use by cooperating engagement elements 21, 31 (for example, a screw or bayonet fitting) which provide mechanical and in some cases electrical connectivity between the power section 20 and the cartridge assembly 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the cartomizer 30. An inductive work coil can be housed in the power section 20 and supplied with power from the battery 5, and the cartomizer 30 and the power section 20 shaped so that when they are connected, there is an appropriate exposure of the heater 4 to flux generated by the coil for the purpose of generating current flow in the material of the heater. Inductive heating arrangements are discussed further below. The FIG. 1 design is merely an example arrangement, and the various parts and features may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. In other examples, the system 10 may be unitary, in that the parts of the control unit 20 and the cartomizer 30 are comprised in a single housing and cannot be separated. Embodiments and examples of the present disclosure are applicable to any of these configurations and other configurations of which the skilled person will be aware.

Figure 2:
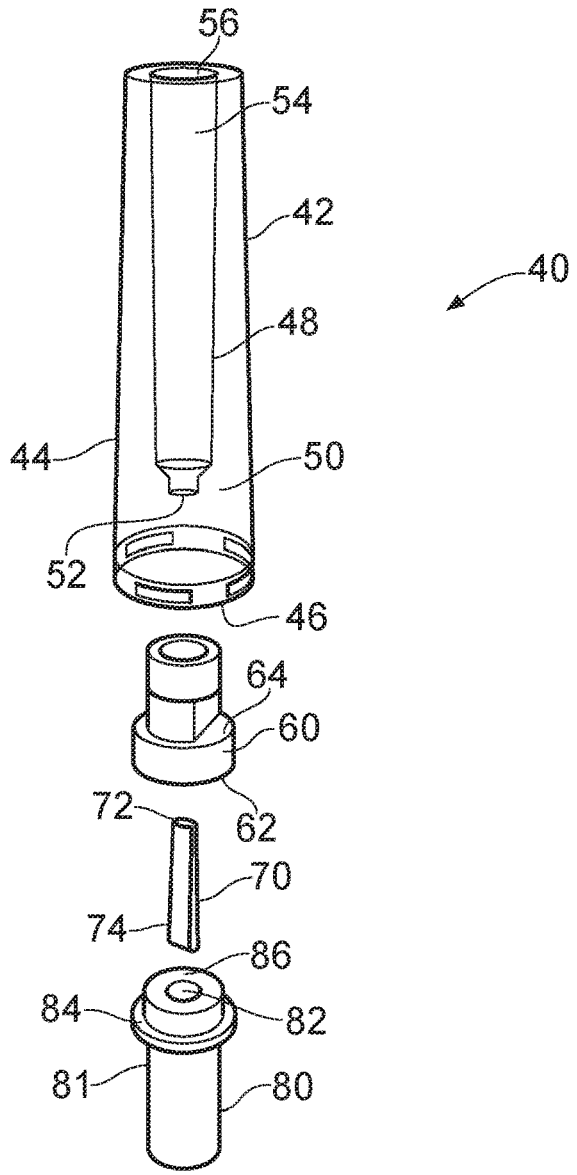
FIG. 2 shows an external perspective exploded view of an example cartomizer in which aspects of the disclosure can be implemented.

FIG. 2 shows an external perspective view of parts which can be assembled to form a cartomizer according to an example of the present disclosure. The cartomizer 40 comprises four parts only, which can be assembled by being pushed or pressed together if appropriately shaped. Hence, fabrication can be made very simple and straightforward.

A first part is a housing 42 that defines a reservoir for holding aerosolizable substrate material (hereinafter referred to as a substrate or a liquid, for brevity). The housing 42 has a generally tubular shape, which in this example has a circular cross-section, and comprises a wall or walls shaped to define various parts of the reservoir and other items. A cylindrical outer side wall 44 is open at its lower end at an opening 46, which may be circular, through which the reservoir may be filled with liquid, and to which parts can be joined as described below, to close/seal the reservoir and also enable an outward delivery of the liquid for vaporization. This defines an exterior or external volume or dimensions of the reservoir. References herein to elements or parts lying or being located externally to the reservoir are intended to indicate that the part is outside or partially outside the region bounded or defined by this outer wall 44 and its upper and lower extent and edges or surfaces.

A cylindrical inner wall 48 is concentrically arranged within the outer side wall 44. This arrangement defines an annular volume 50 between the outer wall 44 and the inner wall 48 which is a receptacle, cavity, void or similar to hold liquid, in other words, the reservoir. The outer wall 44 and the inner wall 48 are connected together (for example by a top wall or by the walls tapering towards one another) in order to close the upper end of the reservoir volume 50. The inner wall 48 is open at its lower end at an opening 52 which may be circular, and also at its upper end. The tubular inner space bounded by the inner wall and hence occupying the central region within the annular reservoir is an air flow passage or channel 54 that, in the assembled system, carries generated aerosol from an atomizer to a mouthpiece outlet of the system for inhalation by a user. The opening 56 at the upper end of the inner wall 48 can be the mouthpiece outlet, configured to be comfortably received in the user's mouth, or a separate mouthpiece part can be coupled on or around the housing 42 having a channel connecting the opening 56 to a mouthpiece outlet.

The housing 42 may be formed from molded plastic material, for example by injection molding. In the example of FIG. 2, it is formed from transparent material; this allows the user to observe a level or amount of liquid in the reservoir 44. The housing might alternatively be opaque, or opaque with a transparent window through which the liquid level can be seen. The plastic material may be rigid in some examples.

A second part of the cartomizer 40 is a flow directing member 60, which in this example also has a circular cross-section, and is shaped and configured for engagement with the lower end of the housing 42. The flow directing member 60 is effectively a bung, and is configured to provide a plurality of functions. When inserted into the lower end of the housing 42, it couples with the opening 46 to close and seal the reservoir volume 50 and couples with the opening 52 to seal off the air flow passage 54 from the reservoir volume 50. Additionally, the flow directing member 60 has at least one channel passing through it for liquid flow, which is in communication with and carries liquid from the reservoir volume 50 to a space or volume external to the reservoir which acts as an aerosol chamber where vapor/aerosol is generated by heating the liquid. Also the flow directing member 60 has at least one other channel passing through it for aerosol flow, which carries the generated aerosol from the aerosol chamber space to the air flow passage 54 in the housing 42, with which it is in communication, so that it is delivered to the mouthpiece opening for inhalation.

Also, the flow directing member 60 may be made from a flexible resilient material such as silicone so that it can be easily engaged with the housing 46 via a friction fit. Additionally, the flow directing member has a socket or similarly-shaped formation (not shown) on its lower surface 62, opposite to the upper surface or surfaces 64 which engage with the housing 42. The socket receives and supports an atomizer 70, being a third part of the cartomizer 40.

The atomizer 70 has an elongate shape with a first end 72 and a second end 74 oppositely disposed with respect to its elongate length. In the assembled cartomizer, the atomizer is mounted at its first end 72 which pushes into the socket of the flow directing member 60 in a direction towards the reservoir housing 42. The first end 72 is therefore supported by the flow directing member 60, and the atomizer 70 extends lengthwise outwardly from the reservoir substantially along the longitudinal axis defined by the concentrically shaped parts of the housing 42. The second end 74 of the atomizer 70 is not mounted, and is left free. Accordingly, the atomizer 70 is supported or held in a cantilevered manner extending outwardly from the exterior bounds of the reservoir. The atomizer 70 performs a wicking function and a heating function in order to generate aerosol, and may comprise any of several configurations of an electrically resistive heater portion configured to act as an inductive susceptor, and a porous portion configured to wick liquid from the reservoir to the vicinity of the heater.

A fourth part of the cartomizer 40 is an enclosure or shroud 80. Again, this has a circular cross-section in this example. It comprises a cylindrical side wall 81 closed by an optional base wall to define a central hollow space or void 82. The upper rim 84 of the side wall 81, around an opening 86, is shaped to enable engagement of the enclosure 80 with reciprocally shaped parts on the flow directing member 60 so that the enclosure 80 can be coupled to the flow directing member 60 once the atomizer 70 is fitted into the socket on the flow directing member 60. The flow directing member 60 hence acts as a cover to close the central space 82, and this space 82 creates an aerosol chamber in which the atomizer 70 is disposed. The opening 86 allows communication with the liquid flow channel and the aerosol flow channel in the flow directing member 60 so that liquid can be delivered to the atomizer and generated aerosol can be removed from the aerosol chamber. In order to enable a flow of air through the aerosol chamber to pass over the atomizer 70 and collect the vapor such that it becomes entrained in the air flow to form an aerosol, the wall or walls 81 of the enclosure 80 have one or more openings or perforations to allow air to be drawn into the aerosol chamber when a user inhales via the mouthpiece opening of the cartomizer.

The enclosure 80 may be formed from a plastics material, such as by injection molding. It may be formed from a rigid material, and can then be readily engaged with the flow directing member by pushing or pressing the two parts together.

As noted above, the flow directing member can be made from a flexible resilient material, and may hold the parts coupled to it, namely the housing 42, the atomizer 70 and the enclosure 80, by friction fit. Since these parts may be more rigid, the flexibility of the flow directing member, which enables it to deform somewhat when pressed against these other parts, accommodates any minor errors in the manufactured size of the parts. In this way, the flow directing part can absorb manufacturing tolerances of all the parts while still enabling quality assembly of the parts altogether to form the cartomizer 40. Manufacturing requirements for making the housing 42, the atomizer 70 and the enclosure 80 can therefore be relaxed somewhat, reducing manufacturing costs.

Figure 3:
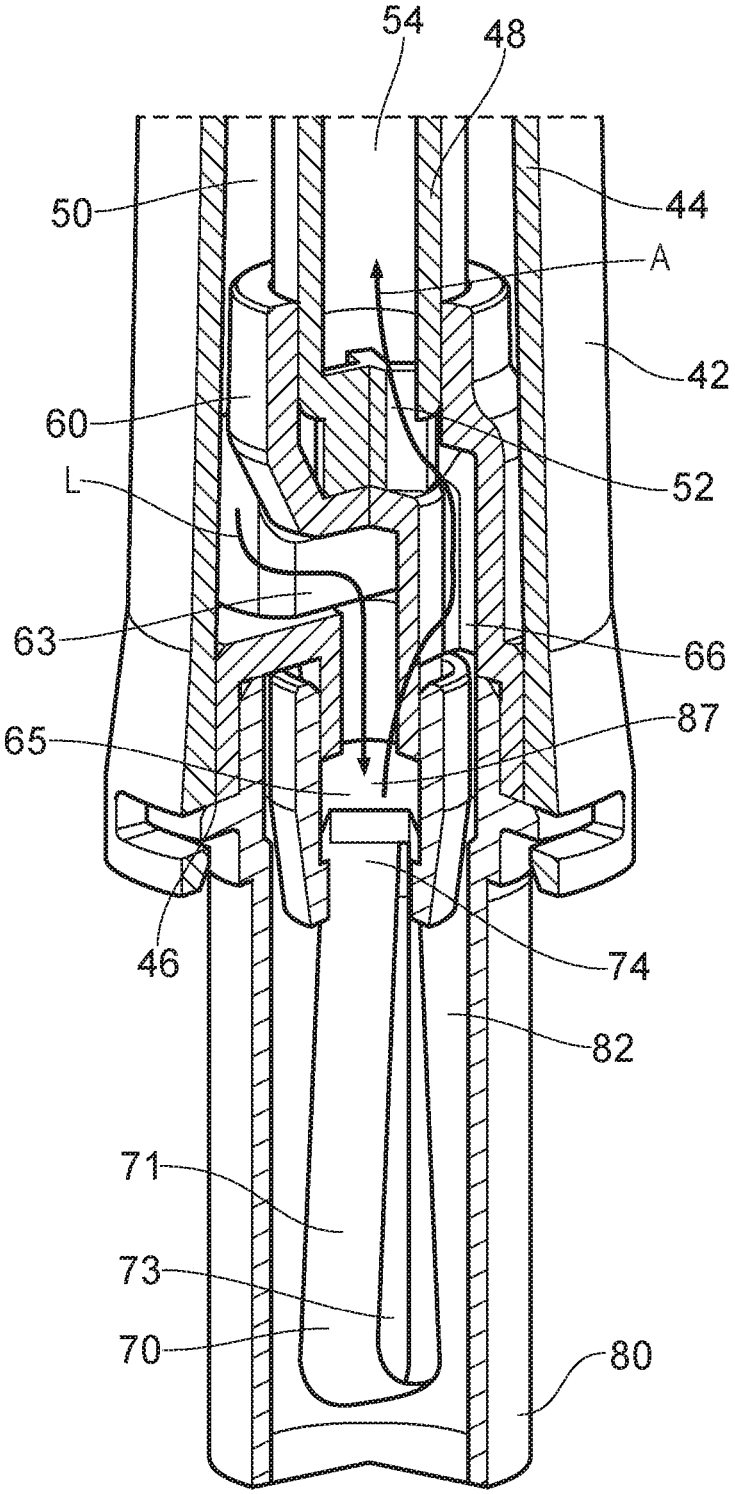
FIG. 3 shows a partially cut-away perspective view of the cartomizer of FIG. 2 in an assembled arrangement.

FIG. 3 shows a cut-away perspective view of the cartomizer of FIG. 1 in an assembled configuration. For clarity, the flow directing member 60 is shaded. It can be seen how the flow directing member 60 is shaped on its upper surfaces to engage around the opening 52 defined by the lower edge of the inner wall 48 of the reservoir housing 42, and concentrically outwardly to engage in the opening 46 defined by the lower edge of the outer wall 44 of the housing 42, in order to seal both the reservoir space 50 and the air flow passage 54.

The flow directing member 60 has a liquid flow channel 63 which allows the flow of liquid L from the reservoir volume 50 through the flow directing member 60 into a space or volume 65 under the flow directing member 60 and external to the reservoir 50. The liquid flow channel 63 has a liquid inlet in communication with the reservoir 50 and a liquid outlet in communication with the volume 65. Also, there is an aerosol flow channel 66 which allows the flow of aerosol and air A from the space 65 through the flow directing member 60 to the air flow passage 54. The aerosol flow channel 66 has an aerosol inlet in communication with the volume 65 and an aerosol outlet in communication with the air flow passage 54

The enclosure 80 is shaped at its upper rim to engage with corresponding shaped parts in the lower surface of the flow directing member 60, to create the aerosol chamber 82 substantially outside the exterior dimensions of the volume of the reservoir 50 according to the reservoir housing 42. In this example, the enclosure 80 has an aperture 87 in its upper end proximate the flow directing member 60. This coincides with the space 65 with which the liquid flow channel 63 and the aerosol flow channel 66 communicate, and hence allows liquid to enter the aerosol chamber 82 and aerosol to leave the aerosol chamber 82 via the channels in the flow directing member 60. The space 65 can be considered as a part of the aerosol chamber 82, so that the liquid flow channel 63 and the aerosol flow channel 66 respectively flow into and flow out of a space or volume for aerosol generation.

In this example, the aperture 87 also acts as a socket for mounting the first, supported, end 74 of the atomizer 70 (recall that in the FIG. 2 description, the atomizer socket was mentioned as being formed in the flow directing member, either option can be used). Thus, liquid arriving through the liquid flow channel 63 and arriving in the space 65 is fed directly to the first end of the atomizer 70 for absorption and wicking, and air/aerosol can be drawn through and past the atomizer to enter the aerosol flow channel 66.

In this example, the atomizer 70 comprises a planar elongate portion of metal 71 which is folded or curved at its midpoint to bring the two ends of the metal portion adjacent to one another at the first end of the atomizer 74. This acts as the heater component of the atomizer 70. A portion of cotton or other porous material 73 is sandwiched between the two folded sides of the metal portion. This acts as the wicking component of the atomizer 70. Liquid arriving in the space 65 is collected by the absorbency of the porous wick material 73 and carried downwards to the heater. Many other arrangements of an elongate atomizer suitable for cantilevered mounting are also possible and may be used instead.

The heater component is intended for heating via induction, which will be described further below.

The example of FIGS. 2 and 3 has parts with substantially circular symmetry in a plane orthogonal to the longitudinal dimension of the assembled cartomizer (where the reservoir and the aerosol chamber are located separately along this dimension). Hence, the parts are free from any required orientation in the planes in which they are joined together, which can give ease of manufacture. The parts can be assembled together in any rotational orientation about the axis of the longitudinal dimension, so there is no requirement to place the parts in a particular orientation before assembly. This is not essential, however, and the parts may be alternatively shaped.

Figure 4:
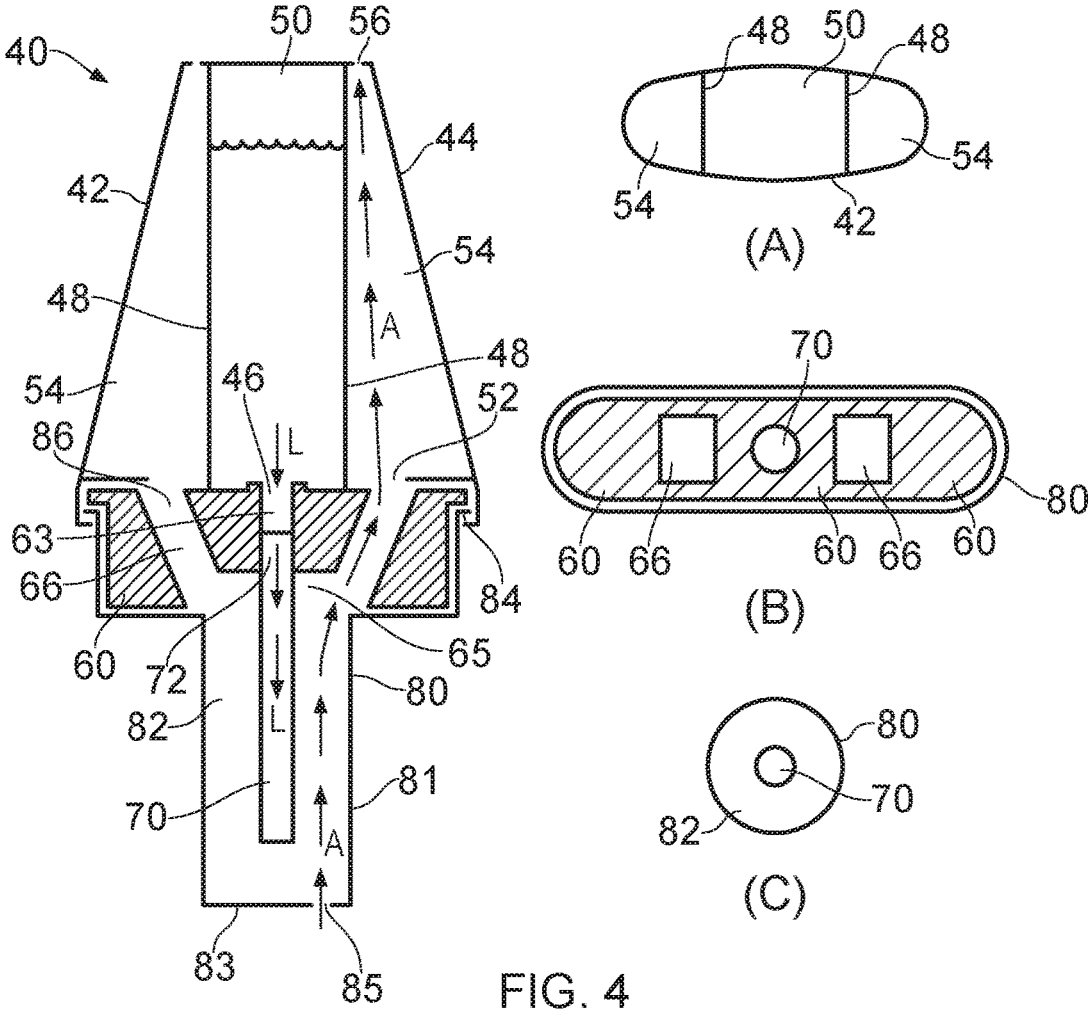

FIG. 4 shows a cross-sectional view through a further example assembled cartomizer comprising a reservoir housing, a flow directing member, an atomizer and an enclosure, as before. In this example, though, in the plane orthogonal to the longitudinal axis of the cartomizer 40, at least some of the parts have an oval or otherwise elongated shape instead of a circular shape, and are arranged to have symmetry along the major axis and the minor axis of the oval. Features are reflected on either side of the major axis and on either side of the minor axis. This means that for assembly the parts can have either of two orientations, rotated from each other by 180° about the longitudinal axis. Again, assembly is simplified compared to a system comprising parts with no symmetry.

In this example, the enclosure 80 again comprises a side wall 81, which is formed so as to have a varying cross-section at different points along the longitudinal axis of the enclosure, and a base wall 83, which bound a space that creates the aerosol chamber 82. Towards its upper end, the enclosure broadens out to a large cross-section to give room to accommodate the flow directing member 60. The large cross-section portion of the enclosure 80 has a generally oval cross-section (see FIG. 4(B)), which the narrower cross-section portion of the enclosure has a generally circular cross-section (see FIG. 4(C)). The enclosure's upper rim 84, around the top opening 86, is shaped to engage with corresponding shaping on the reservoir housing 42. This shaping and engagement is shown in simplified form in FIG. 4; in reality it is likely to be more complex in order to provide a reasonably air-tight and liquid-tight join. The enclosure 80 has at least one opening 85, in this case in the base wall 83, to allow air to enter the aerosol chamber during user inhalation.

The reservoir housing 42 is differently shaped compared with the FIGS. 2 and 3 example. The outer wall 44 defines an interior space which is divided into three regions by two inner walls 48. The regions are arranged side by side. The central region, between the two inner walls 48 is the reservoir volume 50 for holding liquid. This region is closed at the top by a top wall of the housing. An opening 46 in the base of the reservoir volume allows liquid to be delivered from the reservoir 50 to the aerosol chamber 82 via the space 65. The two side regions, between the outer wall 44 and the inner walls 48, are the air flow passages 54. Each has an opening 52 at its lower end for aerosol to enter, and a mouthpiece opening 56 at its upper end (as before, a separate mouthpiece portion might be added externally to the reservoir housing 42). Hence, there are two air flow passages each arranged laterally in an outward direction from a central reservoir which is longitudinally arranged with respect to the aerosol chamber.

A flow directing member 60 (shaded for clarity) is engaged into the lower edge of the housing 42, via shaped portions to engage with the openings 46 and 52 in the housing 42 to close/seal the reservoir volume 50 and the air flow passages 54. The flow directing member 60 has a single centrally disposed liquid flow channel 63 aligned with the reservoir volume opening 46 to transport liquid L from the reservoir to the aerosol chamber 82. Further, there are two aerosol flow channels 66, each running from an inlet at the aerosol chamber 82 to an outlet into the air flow passages 54, by which air entering the aerosol chamber through the hole 85 and collecting vapor in the aerosol chamber 82 flows into the air flow passages 54 to the mouthpiece outlets 56.

The atomizer 70 is mounted by insertion of its first end 72 into the liquid flow channel 63 of the flow directing component 60. Hence, in this example, the liquid flow channel 63 acts as a socket for the cantilevered mounting of the atomizer 70. The first end 72 of the atomizer 70 is thus directly fed with liquid entering the liquid flow channel 60 from the reservoir 50, and the liquid is taken up via the porous properties of the atomizer 70 and drawn along the atomizer length to be heated by the heater portion of the atomizer 70 (not shown) which is located in the aerosol chamber 70.

FIGS. 4(A), (B) and (C) show cross-sections through the cartomizer 40 at the corresponding positions along the longitudinal axis of the cartomizer 40. These show the elongated non-circular shape of the parts in the transverse direction, and the 180° rotational symmetry that allows engagement of the parts in either of two orientations.

While aspects of the disclosure are relevant to atomizers in which the heating aspect is implemented via resistive heating, which requires electrical connections to be made to a heating element for the passage of current, the design of the cartomizer has particular relevance to the use of induction heating. This is a process by which a electrically conducting item, typically made from metal, is heated by electromagnetic induction via eddy currents flowing in the item which generates heat. An induction coil (working coil) operates as an electromagnet when a high-frequency alternating current from an oscillator is passed through it; this produces a magnetic field. When the conducting item is placed in the flux of the magnetic field, the field penetrates the item and induces electric eddy currents. These flow in the item, and generate heat according to current flow against the electrical resistance of the item via Joule heating, in the same manner as heat is produced in a resistive electrical heating element by the direct supply of current. An attractive feature of induction heating is that no electrical connection to the conducting item is needed; the requirement instead is that a sufficient magnetic flux density is created in the region occupied by the item. In the context of vapor provision systems, where heat generation is required in the vicinity of liquid, this is beneficial since a more effective separation of liquid and electrical current can be effected. Assuming no other electrically powered items are placed in a cartomizer, there is no need for any electrical connection between a cartomizer and its power section, and a more effective liquid barrier can be provided by the cartomizer wall, reducing the likelihood of leakage.

Induction heating is effective for the direct heating of an electrically conductive item, as described above, but can also be used to indirectly heat non-conducting items. In a vapor provision system, the need is to provide heat to liquid in the porous wicking part of the atomizer in order to cause vaporization. For indirect heating via induction, the electrically conducting item is placed adjacent to or in contact with the item in which heating is required, and between the work coil and the item to be heated. The work coil heats the conducting item directly by induction heating, and heat is transferred by thermal radiation or thermal conduction to the non-conducting item. In this arrangement, the conducting item is termed a susceptor. Hence, in an atomizer, the heating component can be provided by an electrically conductive material (typically metal) which is used as an induction susceptor to transfer heat energy to a porous part of the atomizer.

Figure 5:
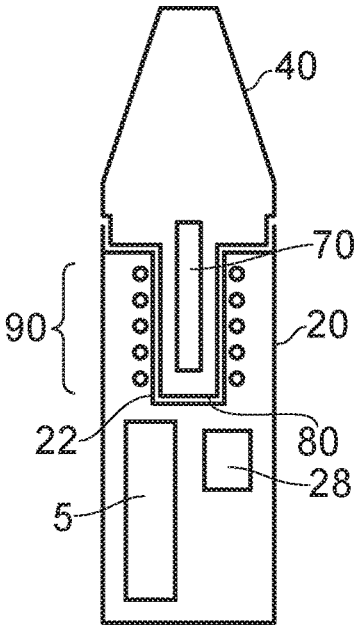
FIG. 5 shows a highly schematic cross-sectional view of a first example vapor provision system employing induction heating in which aspects of the disclosure can be implemented.

FIG. 5 shows a highly simplified schematic representation of a vapor provision system comprising a cartomizer 40 according to examples of the present disclosure and a power component 20 configured for induction heating. The cartomizer 40 may be as shown in the examples of FIGS. 2, 3 and 4 (although other arrangements are not excluded), and is shown in outline only for simplicity. The cartomizer 40 comprises an atomizer 70 in which the heating is achieved by induction heating so that the heating function is provided by a susceptor (not shown). The atomizer 70 is located in the lower part of the cartomizer 40, surrounded by the enclosure 80, which acts not only to define an aerosol chamber but also to provide a degree of protection for the atomizer 70, which could be relatively vulnerable to damage owing to its cantilevered mounting. The cantilever mounting of the atomizer 70 enables effective induction heating however, because the atomizer 70 can be inserted into the inner space of a coil 90, and in particular, the reservoir is positioned away from the inner space of the work coil 90. Hence, the power component 20 comprises a recess 22 into which the enclosure 80 of the cartomizer 40 is received when the cartomizer 40 is coupled to the power component for use (via a friction fit, a clipping action, a screw thread, or a magnetic catch, for example). An induction work coil 90 is located in the power component 20 so as to surround the recess 22, the coil 90 having a longitudinal axis over which the individual turns of the coil extend and a length which substantially matches the length of the susceptor so that the coil 90 and the susceptor overlap when the cartomizer 40 and the power component 20 are joined. In other implementations, the length of the coil may not substantially match the length of the susceptor, e.g., the length of the susceptor may be shorter than the length of the coil, or the length of the susceptor may be longer than the length of the coil. In this way, the susceptor is located within the magnetic field generated by the coil 90. If the items are located so that the separation of the susceptor from the surrounding coil is minimized, the flux experienced by the susceptor can be higher and the heating effect made more efficient. However, the separation is set at least in part by the width of the aerosol chamber formed by the enclosure 80, which needs to be sized to allow adequate air flow over the atomizer and to avoid liquid droplet entrapment. Hence, these two requirements need to be balanced against one another when determining the sizing and positioning of the various items.

The power component 20 comprises a battery 5 for the supply of electrical power to energize the coil 90 at an appropriate AC frequency. Also, there is included a controller 28 to control the power supply when vapor generation is required, and possibly to provide other control functions for the vapor provision system which are not considered further here. The power component may also include other parts, which are not shown and which are not relevant to the present discussion.

The FIG. 5 example is a linearly arranged system, in which the power component 20 and the cartomizer 40 are coupled end-to-end to achieve a pen-like shape.

Figure 6:
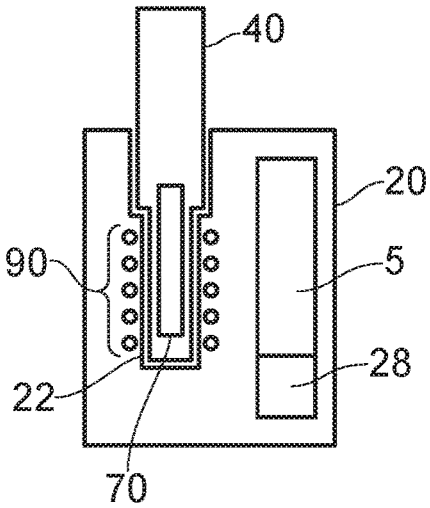
FIG. 6 shows a highly schematic cross-sectional view of a second example vapor provision system employing induction heating in which aspects of the disclosure can be implemented.

FIG. 6 shows a simplified schematic representation of an alternative design, in which the cartomizer 40 provides a mouthpiece for a more box-like arrangement, in which the battery 5 is disposed in the power component 20 to one side of the cartomizer 40. Other arrangements are also possible.

The examples of cartomizer described above include a flow directing member, which in general terms is a component of the cartomizer which engages with the reservoir housing in order to close the reservoir and the air flow passage, so that these regions or volumes are separated from one another and to retain liquid inside the reservoir volume. The closure of the volumes is partial in that the flow directing member also has at least one liquid flow channel that communicates with the reservoir to allow liquid to flow outwardly from the reservoir, and at least one aerosol flow channel that communicates with the air flow passage to allow aerosol to flow inwardly into the air flow passage.

The flow directing member may have just one liquid flow channel, as in the FIG. 4 example, or may have two or more liquid flow channels. The FIG. 3 example is suitable for two or more liquid flow channels, if desired, since the annular nature of the reservoir allows two, three or more liquid flow channel inlets to be angularly spaced apart around the annulus of the reservoir. For example, two inlets can be provided positioned oppositely across the diameter of the reservoir.

Similarly, the flow directing member may have just one aerosol flow channel, or may have two or more aerosol flow channels. In the FIG. 3 example, a single aerosol flow channel 66 is visible, but an additional aerosol flow channel or additional aerosol flow channels can be spaced apart around the circular form of the flow directing member. The FIG. 4 example has two aerosol flow channels to deliver aerosol simultaneously to both air flow passages. However, if a lesser quantity of aerosol is intended, a single aerosol flow channel can be provided so that when the cartomizer is assembled, only one of the two air flow passages is operable and able to receive aerosol from the aerosol chamber and deliver it to a mouthpiece outlet. The other air flow passage will not be connected to the aerosol chamber by an aerosol flow channel.

In general, the liquid inlet of the or each liquid flow channel and the aerosol outlet of the or each aerosol flow channel are located in an end face of the flow directing member which faces towards the reservoir housing (and will be generally an upper face when the cartomizer is in use in a vapor provision system). Conversely, the liquid outlet of the or each liquid flow channel and the aerosol inlet of the or each aerosol flow channel are located in an opposite end face of the flow directing member that faces towards the aerosol chamber. This will be generally a lower face when the cartomizer is in use in a vapor provision system).

Note that FIGS. 3 and 4 are example arrangements only, and liquid flow channels and aerosol flow channels may be disposed through the flow directing member in other and different shapes, positions and configurations which achieve the same result of transporting liquid and aerosol to and from the specified location, and which will be apparent to the skilled person. The channels may be separated from one another by a significant amount within the dimensions of the flow directing member, or may be closely adjacent (such as in the FIG. 3 example) so that they can be considered to be separated by a dividing wall formed from the material of the flow directing member.

While the channels themselves are separate from one another, the various inlets and outlets may be shared. In other words, one inlet/outlet may be at the same location or coincident with another inlet/outlet. For example, in the FIG. 3 example, the liquid flow channel 63 has a liquid outlet that is centrally located in the lower surface of the flow directing member 60, and any further liquid flow channels with inlets spaced apart around the annular volume of the reservoir can have outlets that join into this same central location. Hence, the outlets may be described as coinciding with one another, and all deliver liquid to the same central space 65 below the flow directing member to be taken up by the centrally located atomizer. Similarly, the aerosol flow channel 66 has an inlet in the central space 65, and any additional aerosol flow channels may use the same inlet and branch off therefrom to follow different paths through the flow directing member 60 to outlets communicating with the air flow passage 54.

The option of different numbers of liquid flow channels and aerosol flow channels gives flexibility to the overall cartomizer design, in that more or less liquid can be delivered for vaporization and more or less aerosol can be collected for inhalation according to the number of channels and the capabilities of the atomizer so that the aerosol output to the user can be specified as desired.

The socket for mounting the atomizer in its cantilevered position in the aerosol chamber can be included as part of the flow directing member if desired. The example of FIG. 4 shows such an arrangement. The formation of the socket can be considered as a support portion of the flow directing member, configured to support the atomizer.

For convenience and simplicity, the liquid flow channel and the socket can be combined into a single through-hole extending through the flow directing member. FIG. 4 shows an example of such a configuration. The liquid outlet end of the liquid flow channel is dimensioned to have a comparable width and/or cross-section with the atomizer, so that the first end of the atomizer can be inserted into the outlet and held therein to be supported in the required cantilevered position. The hold may be by a friction fit, for example, or by a spring action if the atomizer comprises a folded metal heater (see FIG. 3) whose ends may have a bias to open outwards against the material of the flow directing member once the atomizer is inserted into the socket. Liquid entering the liquid inlet of the liquid flow channel from the reservoir is then transported directly along the channel onto the end of the atomizer for absorption by the porous capability of the atomizer. If the atomizer is a close fit inside the socket (for example if it comprises a porous ceramic rod of the same or similar cross-section as the socket), this arrangement can aid in minimizing leakage of liquid from the reservoir. The inserted atomizer acts to seal the liquid flow channel outlet and liquid in the channel is only able to be taken up by the atomizer and delivered for vaporization at the heater, rather than being able to escape as free liquid.

However, such an arrangement is not essential, and the socket may be provided as a shaped portion of the flow directing member which is separate from the liquid flow channel.

Alternatively, in other examples, the flow directing member may not have any support portion for supporting the atomizer.

The flow directing member may have shaped portions configured to engage with correspondingly shaped portions on the reservoir housing so that the two parts can be held together. For example, they may engage via a snap-fit arrangement or a friction fit arrangement, or there may be surfaces which can be placed together and secured by an adhesive or by welding with ultrasound or a laser. Similarly, there may be shaped portions by which the enclosure around the atomizer is coupled to the flow directing member by any of the noted methods, although alternatively the enclosure may couple directly to the reservoir housing, or be formed integrally with the reservoir housing.

The flow directing member may be fabricated by molding, for example (although other manufacturing techniques are not excluded). It may be made from a substantially rigid or non-flexible or non-compressible material. If the other parts of the cartomizer with which the flow directing member couples or engages are made from substantially rigid materials, it may be more convenient to form the flow directing member from a resilient material which is able to flex, elastically deform and/or be compressed. These properties make for ease of engagement, in that the flow directing member can be compressed, squeezed or reshaped slightly in order to be coupled to the other parts in a tight-fitting manner, and then held in place by friction or because the flow directing member is somewhat under compression. As well as making for a simple manufacturing procedure that merely requires parts to be aligned and pushed together without any need for gluing, welding or the like, this approach can provide good sealing against leakage of liquid from the reservoir and act to confine air flow to the air flow passage. Additionally, it can increase acceptable manufacturing tolerances for the reservoir housing and the enclosure (and also the atomizer if the socket is provided on the flow directing member). If the flow directing member has elastic properties and is able to deform by differing amounts when joined with other parts, it can absorb a range of sizing errors or variations in the other, more rigid components. Hence the tolerable range of component dimensions arising from manufacturing variations can be increased. In this way, cartomizer manufacturing can be more efficient with less waste.

To enable this, the flow directing member can be made from a flexible resilient material, in other words a material having the property of being elastically deformable. A useful example is silicone materials, otherwise known as polysiloxanes (synthetic polymers of siloxane). Silicones are typically heat-resistant, making them suitable for use in proximity to or in contact with the heating part of the atomizer. They can also have low chemical reactivity and low toxicity, making them suitable for use in contact with aerosolizable substrate materials intended for making aerosols for human consumption.

Other materials can alternatively be used, such as natural or synthetic rubber, polyurethane, and resilient plastics. Alternatively, the flexibility may be provided by the outer housing being formed of a flexible material, with the flow directing member being formed from a generally rigid material.

Returning to FIG. 4, the disclosure also relates to a housing for defining a reservoir and air flow passages. FIG. 4 shows an example in which an inner volume of the housing, defined by an outer wall, is divided into the three volumes or regions corresponding to the reservoir and the two air flow passages by straight interior walls, which extend across the inner volume between two opposite sides of the inner surface or surfaces of the outer wall. The housing may be otherwise shaped and configured, however.

Figure 7A:
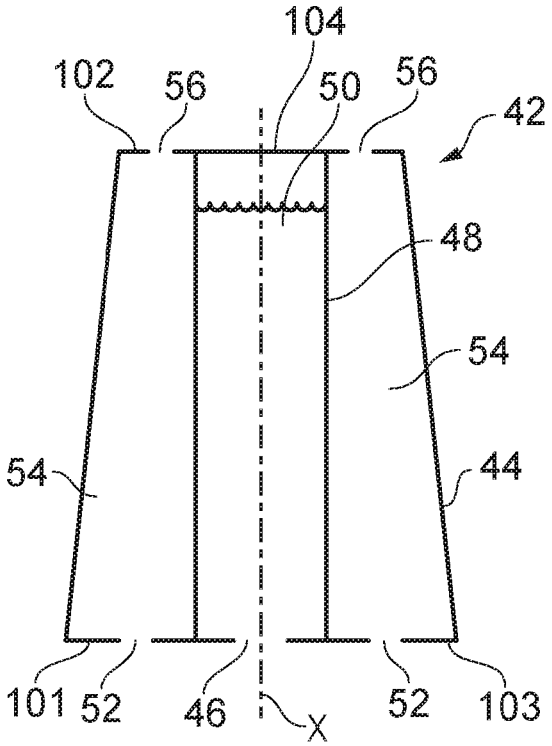
FIG. 7A shows a simplified cross-sectional side view of an example housing according to an aspect of the disclosure.

FIG. 7A shows a cross-sectional side view of a further example housing. The housing 42 comprises an outer wall 44 which extends in a longitudinal direction about a central longitudinal axis X. The outer wall 44, which is generally tubular, defines an inner volume 100 which is bounded by a first end 101 defined by a lower wall 103 of the housing 42 and a second end 102 defined by an upper wall 104 of the housing 42.

Figure 7B:
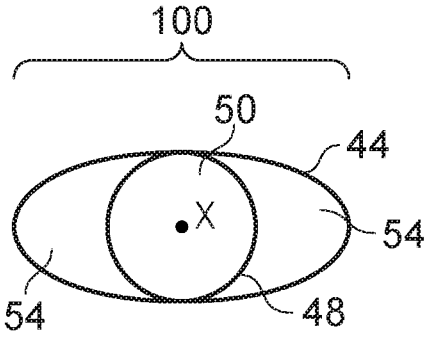
FIG. 7B shows a transverse cross-sectional view of the example housing in FIG. 7A.

FIG. 7B shows a transverse cross-sectional view of the housing 42. From this, it can be seen that the outer wall 44 has a cross-sectional shape in a plane perpendicular to the longitudinal axis X which is generally oval or otherwise elongate with rounded or curved ends. The outer wall is hence a substantially oval tube in this example.

The housing 42 further comprises an interior wall 48. In this example, the interior wall comprises a cylindrical wall (so that it has a circular cross-section in a plane perpendicular to the longitudinal axis X) with a diameter substantially the same as the smaller width (minor axis) of the oval shape of the outer wall 44. Hence, the interior wall 48, positioned in the inner volume 100 and coaxially inside the outer wall 44, contacts and is connected to the opposite sides of the inner surface of the outer wall 44. The interior wall 48 and the outer wall 44 hence have a common longitudinal axis X. The interior wall 48 extends the full length of the outer wall 44, so as to also be joined to the upper wall 104 and the lower wall 103 of the housing 42. In this way, the interior wall divides the inner volume 100 into three volumes or regions which are separated from one another, and not in any fluid communication. These volumes comprise the reservoir region or volume 50, for storing aerosolizable substrate material, which is the inner, cylindrical space defined by the interior wall 48, and the two air flow passages, volumes or regions 54 which are located one on each side of the reservoir volume 50 (in the transverse cross section as can be appreciated from FIG. 7B), and bounded by the outer surface of the interior wall 48 and the inner surface of the outer wall 44.

The three regions have various openings to enable them to perform their functions. These openings are apertures in the lower wall 103 and the upper wall 104.

The reservoir region 50 is closed at the upper, second, end 102 of the inner volume, so the upper wall 104 is continuous and unbroken across the upper end of the interior wall 48. At the first, lower, end 101 of the inner volume 100, the reservoir has at least one liquid outlet 46 comprising an opening in the lower wall 103. During manufacture, the reservoir region 50 can be filled with liquid through the liquid outlet 46, which then, during use of the housing in a vapor provision system, allows liquid to leave the reservoir region 50 and be supplied to an atomizer for vapor generation.

The air flow regions 54 are provided with openings at both ends. Each has at least one air inlet 52 comprising an opening in the lower wall 103 to allow air carrying vapor to enter the air flow regions 54 as described with respect to FIG. 4. Each air flow region 54 also has at least one air outlet 56 comprising an opening in the upper wall 104 to allow air carrying vapor to exit the air flow regions 54, for delivery of aerosol to a user via a mouthpiece of the vapor provision system (not shown).

The outer wall 44 may have an oval cross section along the full extent of the longitudinal axis, or it may have a differing cross-sectional shape. An oval shape at least at the lower end enables ease of automated coupling to other components, as described with respect to FIG. 4.

Also, the outer wall 44 has a tapering shape, in that it has a larger cross-sectional area at the first, lower, end 101 than at the second, upper end 102. Hence, the outer wall tapers inwardly from the first end to the second end. This enables the housing 42 to define a smoothly decreasing profile between its lower end where it is coupled to other parts of a cartomizer or vapor provision system and its upper end where it can be coupled to a mouthpiece which may be desired to have a narrower width than lower parts of the vapor provision system intended to be held by the user.

Overall, the outer shape of the housing 42 defined by the outer wall 44 is that of a truncated cone (truncated at the second, upper end 102) with an oval base (at the first, lower end 101).

The inwardly tapering outer wall 44, in conjunction with the non-tapering cylindrical interior wall 48, is a convenient way to define air flow passages 54 which are narrower towards the air outlet end compared with the air inlet end. The narrowing is provided in a substantially smooth and uniform manner. This provides a gradual increase in the velocity of air which is drawn through the air flow passages when a user inhales on the vapor provision system. The aerosol is hence delivered to the user at a higher speed. Also, the smooth shapes of the interior of the air flow passages 54 that are provided by the oval outer wall 44 and cylindrical inner wall 48 avoid sudden changes in the cross-section of the air flow passages. Hence there are no bends, corners or similar surfaces which could encourage the unwanted deposition of aerosol on the inside of the air flow passage, and aerosol delivery to the user is maximized.

The configuration of the interior wall 48 as a cylindrical component also helps to provide increased physical strength to the oval outer wall 44. Given that the housing will typically be molded from a plastics material, which may be rigid, this increased strength can help to resist accidental crushing or other breakage of the housing which would lead to undesirable spilling of the reservoir contents.

The housing of FIG. 7A may additionally comprise one or more features at its lower end 101 for engagement of the housing with one or more additional components in order to make up a cartomizer or cartridge, for example as the reservoir housing is coupled to the shroud and/or the flow directing member in the preceding examples. The upper end may similarly comprise features for engagement with an external vapor provision system mouthpiece, for example.

Figure 8:
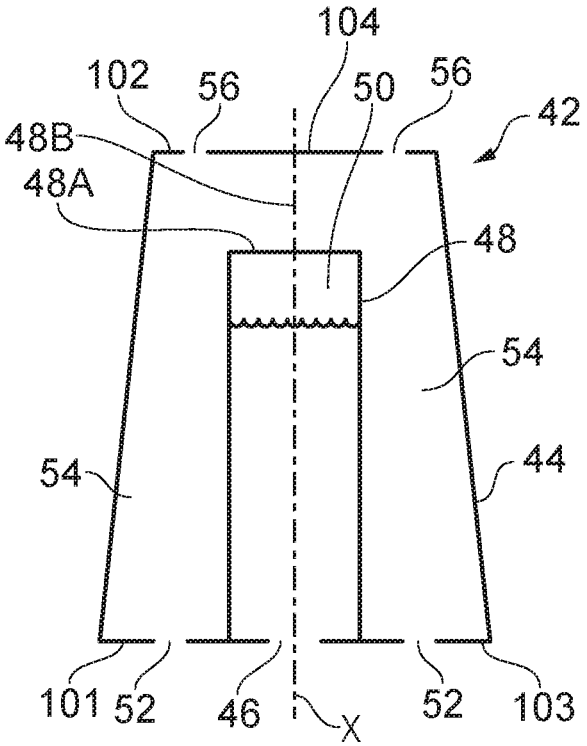
FIG. 8 shows a simplified cross-sectional side view of another example housing according to an aspect of the disclosure.

FIG. 8 shows a cross-sectional view of another example housing, which is modified compared to the FIGS. 7A example in that the interior wall 48 extends from the lower wall 103 defining the first end 101 of the interior volume only a part of the way towards the upper wall 104 defining the second end 102 of the interior volume. The top of the interior wall 48 is closed by a secondary interior wall 48A which closes the reservoir region 50 and divides the reservoir region 50 from the air flow regions 54. Hence the reservoir region 50 is closed adjacent to the second end 102 of the interior volume, rather than at the second end 102 as in the FIG. 7A example. A interior partition 48B extends from the secondary interior wall 48A to the upper wall 104 in order to divide the upper part of the interior volume into the two air flow passages 54. The secondary interior wall 48A and the interior partition 48B can be considered to be part of the interior wall 48, in that these three elements act together to divide the interior volume into the desired three regions 50, 54. In an alternative arrangement, the interior partition 48B may be omitted. In this case, the air flow passages 54 are separated from one another in the lower part of the interior volume by the interior wall 48 bounding the reservoir 50, and are combined into a shared region above the reservoir region 50. A single air outlet 56 in the upper wall 104 may then suffice.

While three example housings have been described, with respect to FIGS. 4, 7A/7B and 8, this aspect of the disclosure is not limited to the precise configuration of these examples. In particular, the shapes of the outer wall and the interior wall or walls may be different from the examples in the transverse cross-sectional plane while still providing a housing having three regions (one reservoir volume or region between two air flow passages or volumes/regions) arranged side-by-side so as to each extend over most or all of the full length of the housing. For example, the outer wall 44 may not taper inwardly towards the upper end 102.

In conclusion, in order to address various issues and advance the art, this disclosure shows by way of illustration various embodiments in which the claimed disclosure(s) may be practiced. The advantages and features of the disclosure are of a representative sample of embodiments only, and are not exhaustive and/or exclusive. They are presented only to assist in understanding and to teach the claimed disclosure(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other disclosures not presently claimed, but which may be claimed in future.

The invention claimed is:

1. A flow directing member for a vapor provision system, configured for engagement with an opening in a wall of a housing defining a reservoir for aerosolizable substrate material and with an opening in a wall of the housing defining an air flow passage, the flow directing member comprising:

a first liquid flow channel extending therethrough from a first liquid inlet to a first liquid outlet such that when the flow directing member is engaged with the housing, the first liquid inlet is in communication with the reservoir and the first liquid outlet is in communication with a volume for aerosol generation external to the reservoir so that aerosolizable substrate material can flow from the reservoir to the volume;

a second liquid flow channel extending from a second liquid inlet to a second liquid outlet, wherein the second liquid outlet is coincident with the first liquid outlet of the first liquid flow channel; and a first aerosol flow channel extending therethrough from a first aerosol inlet to a first aerosol outlet such that when the flow directing member is engaged with the housing, the first aerosol inlet is in communication with the volume and the first aerosol outlet is in communication with the air flow passage so that aerosol can flow from the volume to the air flow passage.

2. A flow directing member according to claim 1, wherein the flow directing member is shaped for engagement with a housing having walls that define an annular reservoir and an air flow passage in the central region of the annular reservoir.

3. A flow directing member according to claim 2, wherein the airflow passage is concentrically located within the annular reservoir.

4. A flow directing member according to claim 2, wherein the flow directing member is shaped for engagement with circular openings in the walls of the housing.

5. A flow directing member according to claim 1, wherein the flow directing member is shaped for engagement with a housing having walls that define a reservoir longitudinally located from the volume and one or more air flow passages located laterally outwardly from the reservoir.

6. A flow directing member according to claim 5, wherein the flow directing member has an elongated shape in a plane transverse to the longitudinal direction that allows engagement with the housing in either of two orientations separated by 180° of rotation about the longitudinal direction.

7. A flow directing member according to claim 2, wherein the liquid outlet and the aerosol inlet are located in an end face of the flow directing member to communicate with a volume for aerosol generation which is located substantially centrally adjacent to the end face.

8. A flow directing member according to claim 1, wherein the flow directing member is formed from a flexible resilient material.

9. A flow directing member according to claim 8, wherein the flow directing member is formed from a silicone material.

10. A flow directing member according to claim 1, wherein the flow directing member is configured for engagement with the housing by a friction fit.

11. A flow directing member according to claim 1, further comprising a dividing wall that separates the liquid flow channel from the aerosol flow channel.

12. A flow directing member according to claim 1, further comprising a second aerosol flow channel extending from a second aerosol inlet to a second aerosol outlet.

13. A flow directing member according to claim 12, wherein the second aerosol inlet is coincident with the first aerosol inlet of the first aerosol flow channel.

14. A flow directing member according to claim 1, further comprising a support portion for supporting an atomizer of the vapor provision system in the volume for aerosol generation.

15. A flow directing member according to claim 14, wherein the liquid outlet of the liquid flow channel is configured as the support portion.

16. A reservoir for holding aerosolizable substrate material in a vapor provision system, comprising a housing having walls that define the reservoir and an air flow passage, and an opening in one of the walls defining the reservoir and another opening in one of the walls defining the air flow passage, and a flow directing member according to claim 1 engaged with the openings.

17. A reservoir according to claim 16, wherein the flow directing member is engaged with the opening in the wall defining the reservoir so as to provide a substantially liquid-tight seal, and with the opening in the wall defining the air flow passage so as to provide a substantially air-tight seal.

18. A reservoir according to claim 16, further comprising aerosolizable substrate material in the reservoir.

19. A housing for a cartomizer portion of a vapor provision system, the housing comprising:

an outer wall defining an inner volume with a longitudinal axis, a first end and a second end;

one or more interior walls extending from at least the first end and connected to an inner surface or surfaces of the outer wall to divide the inner volume into three regions comprising:

a reservoir region closed at or adjacent the second end of the inner volume and having at least one liquid outlet at the first end, the reservoir region having a common longitudinal axis with the outer wall;

and first and second air flow regions arranged one on either side of the reservoir region, and the first and second air flow regions having at least one air inlet at the first end and at least one air outlet at the second end.

20. A housing according to claim 19, wherein the one or more interior walls comprise a cylindrical interior wall connected at two oppositely located circumferential positions to the inner surface or surfaces, to define a cylindrical reservoir region.

21. A housing according to claim 19, wherein the outer wall has an oval shape perpendicular to the longitudinal axis at the second end at least.

22. A housing according to claim 21, wherein the outer wall has an oval shape perpendicular to the longitudinal axis at all points along the longitudinal axis.

23. A housing according to claim 21, wherein the outer wall tapers inwardly from the first end to the second end, such that a cross-section of the inner volume perpendicular to the longitudinal axis is larger at the first end than at the second end.

24. A housing according to claim 23, wherein the outer wall defines an external shape for the housing comprising a cone with an oval base forming the first end and truncated at the second end.

25. A housing according to claim 21, wherein the one or more interior walls extend from the first end to the second end, and the reservoir region is closed at the second end of the inner volume.

26. A housing according to claim 25, wherein the first and second air flow regions have cross-sections perpendicular to the longitudinal axis which become smaller towards the second end.

* * * * *